US008624518B2

(12) United States Patent
Meng et al.

(10) Patent No.: US 8,624,518 B2
(45) Date of Patent: Jan. 7, 2014

(54) POWER MANAGEMENT CIRCUIT AND LIQUID CRYSTAL DISPLAY USING SAME

(75) Inventors: Lu-Qing Meng, Shenzhen (CN); Hai-Long Cheng, Shenzhen (CN); Kuo-Pin Lin, New Taipei (TW); Chun-Lung Hung, New Taipei (TW)

(73) Assignees: Hong Fu Jin Precision Industry (ShenZhen) Co., Ltd, Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 123 days.

(21) Appl. No.: 13/313,004

(22) Filed: Dec. 7, 2011

(65) Prior Publication Data

US 2012/0326619 A1 Dec. 27, 2012

(30) Foreign Application Priority Data

Jun. 24, 2011 (CN) ..... 2011 1 0172830

(51) Int. Cl.
*H05B 37/00* (2006.01)

(52) U.S. Cl.
USPC ..... 315/245; 315/204; 315/214; 315/350

(58) Field of Classification Search
USPC ..... 315/245, 362, 313, 324, 325, 341, 349, 315/350, 204, 214, 215, 211, 212
See application file for complete search history.

(56) References Cited

U.S. PATENT DOCUMENTS

| | | | | |
|---|---|---|---|---|
| 5,982,105 | A * | 11/1999 | Masters | 315/169.3 |
| 2009/0237385 | A1* | 9/2009 | Lee et al. | 345/211 |
| 2010/0156883 | A1* | 6/2010 | Yamato et al. | 345/213 |
| 2011/0012539 | A1* | 1/2011 | Skwarlo | 315/313 |
| 2011/0056399 | A1* | 3/2011 | Yan et al. | 102/215 |

* cited by examiner

*Primary Examiner* — James H Cho
(74) *Attorney, Agent, or Firm* — Altis Law Group, Inc.

(57) ABSTRACT

A power management circuit comprising a power-on signal input, an output terminal a control unit, a switching unit, and a discharge unit. The control unit configured to selectively turn on the switching unit to output a power-on signal to a display module and selectively turn off the switching unit to cut off an electrical connection between the power-on signal input and the output terminal. The discharge unit configured to discharge residual electrical charges in the display module when the switching unit is turned off.

17 Claims, 5 Drawing Sheets

POWER MANAGEMENT CIRCUIT AND LIQUID CRYSTAL DISPLAY USING SAME

BACKGROUND

1. Technical Field

The present disclosure relates to a power management circuit and a liquid crystal display using the same.

2. Description of Related Art

LCDs have the advantages of portability, low power consumption and low radiation, and are used in products such as notebooks, personal digital assistants (PDAs), video cameras, for example. However, when an LCD is powered off, the LCD may still display and not shut down cleanly, experiencing what is called the "shutdown ghost phenomenon." In addition, the LCD may also display what is called "the boot splash screen phenomenon" during a power-on process of the LCD.

Therefore, an LCD to overcome the above described shortcomings is desired.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the several views, and all the views are schematic.

DETAILED DESCRIPTION

Reference will be made to the drawings to describe various embodiments in detail.

Figure 1:
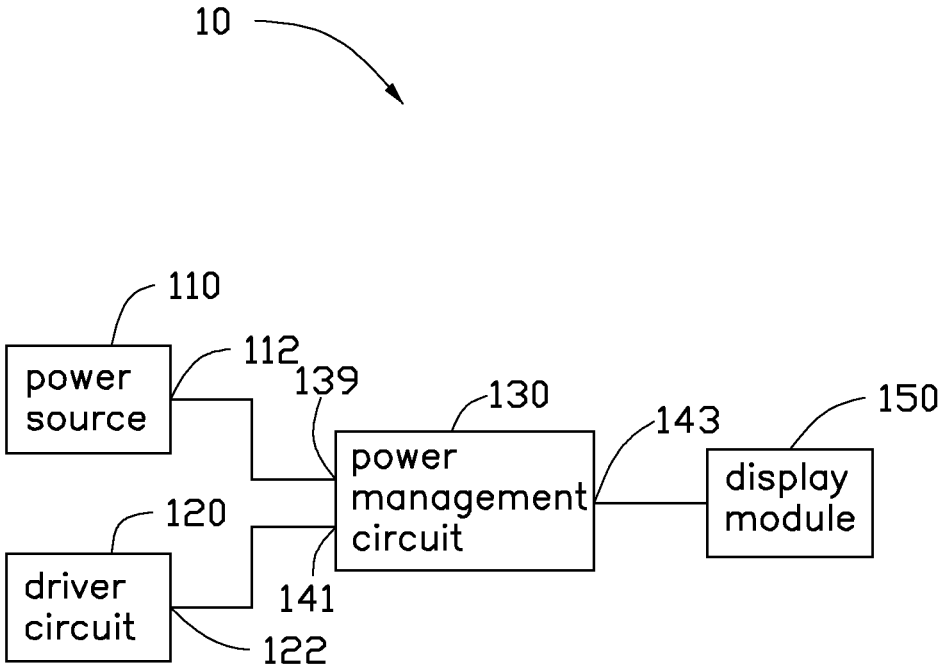
FIG. 1 is a block diagram of a liquid crystal display according to one embodiment of the present disclosure, the liquid crystal display including a power management circuit.

FIG. 1 is a block diagram of a liquid crystal display 10 according to one embodiment of the present disclosure, the liquid crystal display 10 including a power management circuit 130. The liquid crystal display 10 further includes a power source 110, a driver circuit 120, and a display module 150. The power source 110 includes a power output 112 used to provide a power-on signal. In one embodiment, the power source 110 can be a battery. In alternative embodiments, the power source 110 can be an external power supply. The driver circuit 120 is used to detect a current state of the liquid crystal display 10. The state of the liquid crystal display may be a powering-on state, a normal operation state or a power-off state. The driver circuit 120 includes a control signal output terminal 122 configured to output a signal according to the current state of the liquid crystal display 10. The power management circuit 130 includes a power-on signal input 139, a control signal input 141, and an output terminal 143. The power-on signal input 139 is electrically connected to the power-on signal output 112 and configured to receive the power-on signal. The control signal input 141 is electrically connected to the control signal output 122 and used to receive the control signal. The output terminal 143 configured to output the power-on signal to the display module 150. The display module 150 displays data.

In one embodiment, when the liquid crystal display 10 is turned on and working normally, the control signal outputted from the control signal output terminal 122 of the driver circuit 120 is at logic high (1). The power management circuit 130 transmits the power-on signal to the display module 150 according to the received logic high signal. When the liquid crystal display 10 is turned off, the control signal outputted from the control signal output terminal 122 of the driver circuit 120 is at logic low (0). The power management circuit 130 stops transmitting the power-on signal to the display module 150 and discharges any residual electrical charges in the display module 150 quickly when the logic low signal is received.

Figure 2:
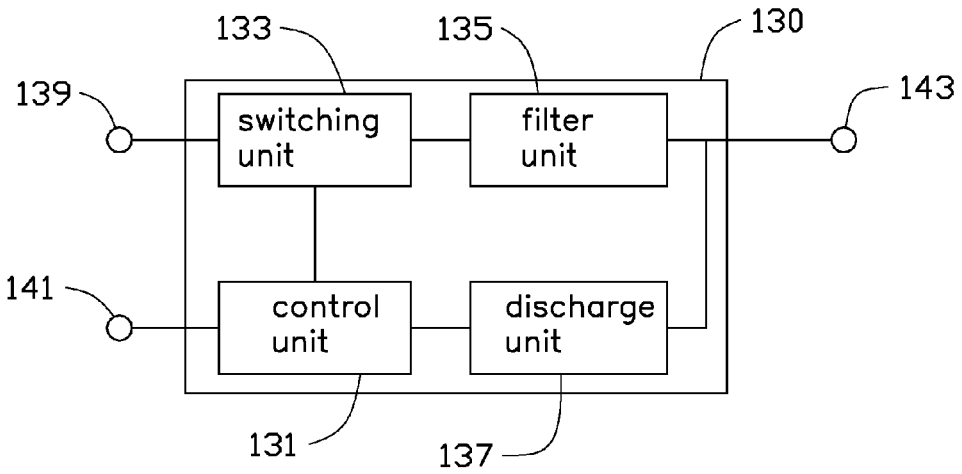
FIG. 2 is a block diagram of a power management circuit of FIG. 1 according to a first embodiment of the present disclosure.

In FIG. 1 and FIG. 2, the power management circuit 130 includes a control unit 131, a switching unit 133 and a discharge unit 137. The control unit 131 is connected to the switching unit 133 and the discharge unit 137. The switching unit 133 is connected between the power-on signal input 139 and the output terminal 143. The discharge unit 137 is connected to the output terminal 143. The control unit 131 turns on or turns off the switching unit 133. The switching unit 133 may electrically connect or electrically disconnect the power source 110 and the display module 150. The discharge unit 137 configured to discharge any residual electrical charges in the display module 150 quickly. When the liquid crystal display 10 is turned on and is working normally, the control signal is input to the control unit 131 through the control signal input 141. The control unit 131 turns on the switching unit 133 to enable the switching unit 133 to transmit the power-on signal to the display module 150 via the output terminal 143. When the liquid crystal display 10 is turned off, the control unit 131 turns off the switching unit 133 to enable the switching unit 133 to disconnect the power source 110 and the display module 150, and enables the discharge unit 137 to simultaneously drain residual electrical charges from the display module 150.

In this embodiment, the power management circuit 130 further comprising a filter unit 135. The filter unit 135 is connected to the switching unit 133 and output terminal 143 for filtering noise of the power-on signal.

Figure 3:
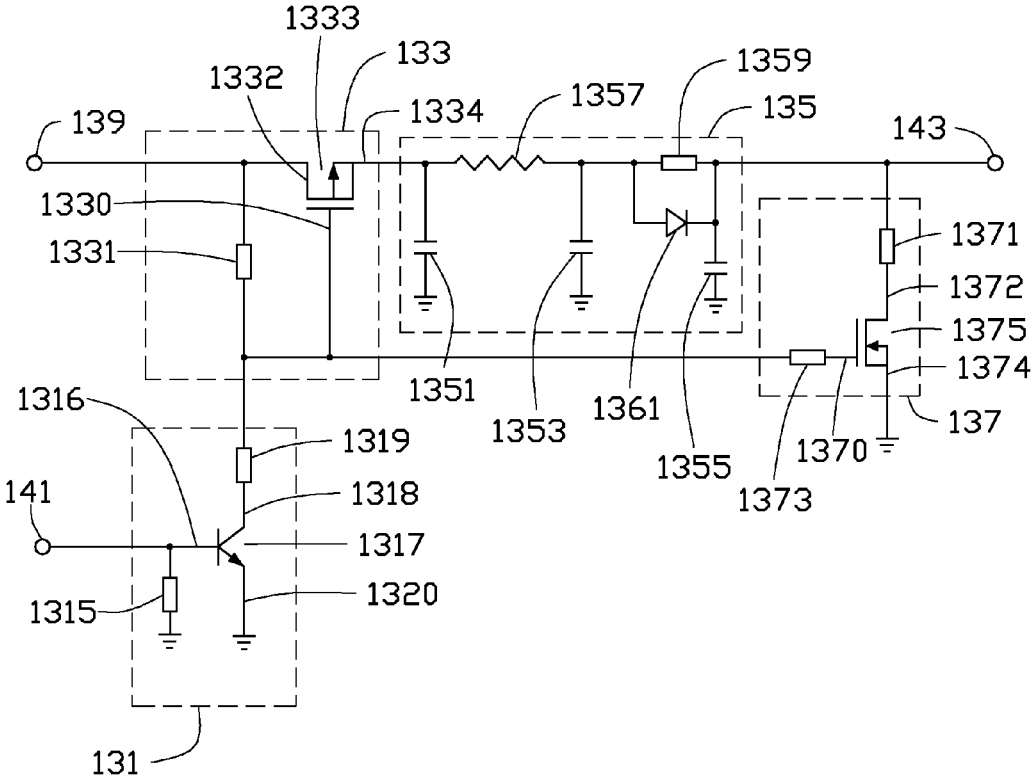
FIG. 3 is a circuit diagram of a power management circuit of FIG. 2 according to one embodiment.

In FIG. 3, the control unit 131 includes a first resistor 1315, a first transistor 1317 and a second resistor 1319. The first transistor 1317 includes a control terminal 1316, a first conducting terminal 1318 and a second conducting terminal 1320. The control terminal 1316 is connected to the control signal input 141. The first conducting terminal 1318 is electrically coupled to the second resistor 1319. The second conducting terminal 1320 is grounded. In this embodiment, the first transistor 1317 is an npn-type bipolar junction transistor (npn-BJT). The control terminal 1316 is a base electrode of the npn-BJT, the first conducting terminal 1318 is a collector electrode of the npn-BJT, and the second conducting terminal 1320 is an emitter electrode of the npn-BJT.

The switching unit 133 includes a third resistor 1331 and a second transistor 1333. The second transistor 1333 includes a control terminal 1330, a first conducting terminal 1332 and a second conducting terminal 1334. The control terminal 1330 of the second transistor 1333 is electrically coupled to the power-on signal input 139 via the third resistor 1331 and to the second resistor 1319 of the control unit 131. The first conducting terminal 1332 is also electrically coupled to the power-on signal input 139. The second conducting terminal 1334 is electrically coupled to the filter unit 135. In this embodiment, the second transistor 1333 is a p-type metal oxide semiconductor field-effect transistor (P-MOSFET).

The control terminal 1330, the first conducting terminal 1332 and the second conducting terminal 1334 are respectively a source electrode, a gate electrode, and a drain electrode of the P-MOSFET.

The discharge unit 137 includes a fourth resistor 1371, a fifth resistor 1373 and a third transistor 1375. The third transistor 1375 includes a control terminal 1370, a first conducting terminal 1372, and a second conducting terminal 1374. The control terminal 1370 of the third transistor 1375 is electrically coupled to the second resistor 1319 of the control unit 131 via the fifth resistor 1373. The first conducting terminal 1372 of the third transistor 1375 is electrically coupled to the output terminal 143. The second conducting terminal 1374 of the third transistor 1375 is grounded.

The filter unit 135 includes a first capacitor 1351, a second capacitor 1353, a third capacitor 1355, an inductor 1357, a sixth resistor 1359 and a diode 1361. The inductor 1357 and the sixth resistor 1359 are electrically coupled between the second conducting terminal 1334 of the second transistor 1334 and the output terminal 143 in series. One end of the inductor 1357 is electrically connected to the second conducting terminal 1334 and grounded via the first capacitor 1351, and the other end of the inductor 1357 is electrically connected to the output terminal 143 via the sixth resistor 1359 and grounded via the second capacitor 1353. The diode 1361 connects in parallel with the sixth resistor 1359. The output terminal 143 is grounded via the third capacitor 1355.

In operation, when the liquid crystal display 10 is turned on, a logic high (1) is defined as the control signal and is transmitted to the control unit 131 via the control signal input 141. The first transistor 1317 is then turned on. As the second conducting terminal 1320 of the first transistor 137 is grounded, a divided voltage between the second resistor 1319 and the third resistor 1331 is transmitted to the control terminal 1330 of the second transistor 1333 via the second resistor 1319. In this embodiment, a resistance of the third resistor 1331 is much greater than that of the second resistor 1319, such that the divided voltage can be defined as a logic low signal, to turn on the second transistor 1333. The power-on signal is filtered by the filter unit 135 and then output to the display module via the output terminal 143.

Furthermore, when the liquid crystal display 10 is turned off, a logic low (0) is defined as the control signal and transmitted to the control unit 131 via the control signal input 141. Thus the first transistor 1317 is turned off and the power-on signal from the power-on signal input 139 is defined as a logic high signal and transmitted to the control terminal 1330 of the second transistor 1333. Thus the second transistor 1333 is turned off and no power-on signal is outputted from the output terminal 143. Thus the display module 150 is turned off. Simultaneously the power-on signal from the power-on signal input 139 is also transmitted to turn on the third transistor 1375. Thus, any residual electrical charges in the display module 150 may be immediately discharged via the current path formed by the fourth resistor 1371 and the third transistor 1375, to ground.

Figure 4:
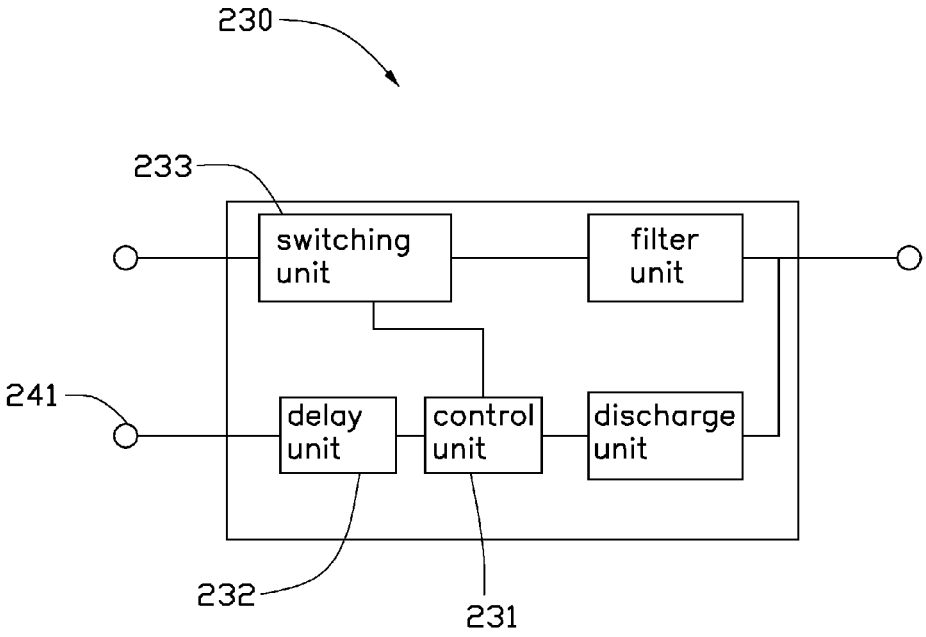
FIG. 4 is a block diagram of a power management circuit according to a second embodiment of the present disclosure.

Referring to FIG. 4, the power management circuit 230 is similar to the power management circuit 130 of the FIG. 2, except that the power management circuit 230 further includes a delay unit 232 between a control signal input 241 and a control unit 232. The delay unit 232 provides a delay time. The control signal is only transmitted to the control unit 234 after being delayed by the delay unit 232. As a result, the boot splash screen phenomenon is eliminated during the powering-on process.

Figure 5:
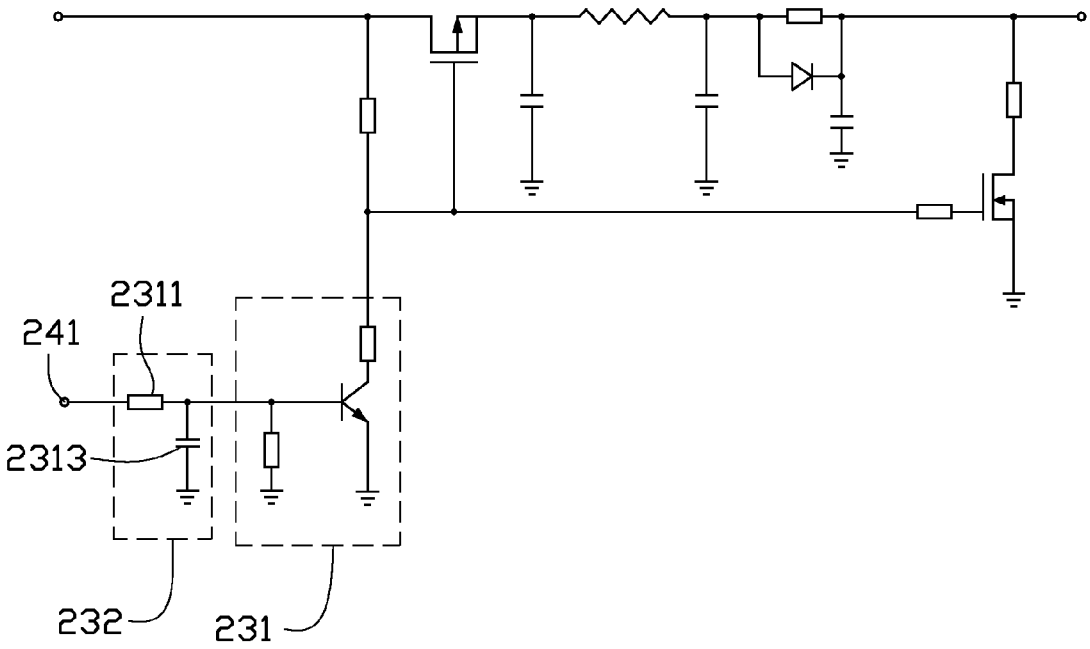
FIG. 5 is a circuit diagram of FIG. 4 according to one embodiment.

Referring to FIG. 5, the delay unit 232 includes a seventh resistor 2311 and a fourth capacitor 2313. The seventh resistor 2311 and the fourth capacitor 2313 form an RC delay circuit. The RC delay circuit may control the forwarding time of the switching unit by adjusting a resistance value of the seventh resistor 2311 and a capacitance value of the fourth capacitor 2313.

In alternative embodiments, when the control signal is a logic low signal (0), the first transistor 1317 is a pnp-BJT.

It is believed that the present embodiments and their advantages will be understood from the foregoing description, and it will be apparent that various changes may be made thereto without departing from the spirit and scope of the embodiments or sacrificing all of their material advantages.

What is claimed is:

1. A power management circuit, comprising:

a power-on signal input configured to receive a power-on signal;

an output terminal configured to provide the power-on signal to a load, the output terminal grounded via a discharge unit;

a switching unit electrically connected between the power-on signal input and the output terminal, the switching unit comprising a first transistor and a first resistor, the first transistor comprising a control terminal, a first conducting terminal and a second conducting terminal; the power-on signal input connected to the first conducting terminal of the first transistor, and the power-on signal input connected to the control terminal of the first transistor via the first resistor;

a control signal input configured to receive a control signal; and a control unit electrically connected to the control signal input, the control unit configured to selectively turn on the switching unit to output the power-on signal to a display module via the output terminal and selectively turn off the switching unit to cut off an electrical connection between the power-on signal input and the output terminal, the discharge unit configured to discharge residual electrical charges in the display module when the switching unit is turned off.

2. The power management circuit of claim 1, wherein the control unit comprises a second resistor, a third resistor and a second transistor; the second transistor comprising a control terminal, a first conducting terminal and a second conducting terminal; the control terminal of the second transistor is electrically coupled to the control signal input, the first conducting terminal of the second transistor is connected to the first resistor, the second conducting terminal of the second transistor is grounded.

3. The power management circuit of claim 1, wherein the discharge unit comprises a third transistor, a fourth resistor and a fifth resistor; the third transistor comprising a control terminal, a first conducting terminal and a second conducting terminal; the first conducting terminal of the third transistor is electrically coupled to the output terminal via the fourth resistor, the second conducting terminal of the third transistor is grounded; the control terminal of the third transistor is electrically coupled to the switching unit via the fifth resistor.

4. The power management circuit of claim 3, wherein when the control signal is a logic low signal, the third transistor is conductive, and the discharge unit releases residual charges in the display module.

5. The power management circuit of claim 1, further comprising a filter unit configured to filter noise of the power-on signal and transmit a direct current to the display module.

6. The power management circuit of claim 1, further comprising a delay unit, the delay unit providing a delay time for the control unit.

7. The power management circuit of claim 6, wherein the delay unit includes an RC delay circuit configured to provide the delay time for the control unit.

8. A liquid crystal display, comprising:

a driver circuit configured to output a control signal;

a display module; and a power management circuit comprising:

a power-on signal input configured to receive a power-on signal;

an output terminal configured to selectively provide the power-on signal to the display module;

a discharge unit electrically connected between the output terminal and ground;

a switching unit electrically connected between the power-on signal input and the output terminal, the switching unit comprising a first transistor and a first resistor, the first transistor comprising a control terminal, a first conducting terminal and a second conducting terminal; the power-on signal input connected to the first conducting terminal of the first transistor, and the power-on signal input connected to the control terminal of the first transistor via the first resistor;

a control signal input configured to receive the control signal; and a control unit electrically connected to the control signal input, the control unit configured to turn on the switching unit to output the power-on signal to the display module via the output terminal and turn off the switching unit to cut off an electrical connection between the power-on signal input and the output terminal, wherein the discharge unit discharges residual electrical charges in the display module when the switching unit is turned off.

9. The liquid crystal display of claim 8, wherein the control unit comprises a second resistor, a third resistor and a second transistor; the second transistor comprising a control terminal, a first conducting terminal and a second conducting terminal; the control terminal of the second transistor is electrically coupled to the control signal input, the first conducting terminal of the second transistor is connected to the first resistor, the second conducting terminal of the second transistor is grounded.

10. The liquid crystal display of claim 9, the power management circuit further comprising a delay unit, the delay unit provides a delay time for the control unit.

11. The liquid crystal display of claim 10, wherein the delay unit includes an RC delay circuit configured to provide the delay time for the control unit.

12. The liquid crystal display of claim 8, wherein the discharge unit comprises a third transistor, a fourth resistor and a fifth resistor; the third transistor comprising a control terminal, a first conducting terminal and a second conducting terminal; the first conducting terminal of the third transistor is electrically coupled to the output terminal via the fourth resistor, the second conducting terminal of the third transistor is grounded; the control terminal of the third transistor is electrically coupled to the switching unit via the fifth resistor.

13. The liquid crystal display of claim 12, wherein when the control signal is a logic low signal, the third transistor is conductive.

14. The liquid crystal display of claim 8, wherein the power management circuit further comprising a filter unit, the filter unit configured to filter noise of the power-on signal and transmit direct current to the display module.

15. A power management circuit, comprising:

a power-on signal input configured to receive a power-on signal;

an output terminal configured to provide the power-on signal to a load, the output terminal grounded via a discharge unit;

a switching unit electrically connected between the power-on signal input and the output terminal, the switching unit comprising a first transistor and a first resistor, the first transistor comprising a control terminal, a first conducting terminal and a second conducting terminal; the power-on signal input connected to the first conducting terminal of the first transistor, and the power-on signal input connected to the control terminal of the first transistor via the first resistor, a control signal input configured to receive a first control signal and a second control signal;

a control unit electrically connected to the control signal input, and wherein when the control unit receiving the first control signal, the power-on signal is transmitted to the load via the first transistor; when the control unit receiving the second control signal, the first transistor turns off and the discharge unit discharges residual electrical charges in the load when the switching unit is turned off.

16. The power management circuit of claim 15, further comprising a delay unit, the delay unit providing a delay time for the control unit.

17. The power management circuit of claim 16, wherein the delay unit comprises an RC delay circuit configured to provide the delay time for the control unit.

* * * * *